US011754951B2

(12) United States Patent
Takagi

(10) Patent No.: US 11,754,951 B2
(45) Date of Patent: Sep. 12, 2023

(54) FIXING DEVICE AND IMAGE FORMING APPARATUS

(71) Applicant: TOSHIBA TEC KABUSHIKI KAISHA, Tokyo (JP)

(72) Inventor: Osamu Takagi, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/685,304

(22) Filed: Mar. 2, 2022

(65) Prior Publication Data

US 2022/0187748 A1 Jun. 16, 2022

Related U.S. Application Data

(63) Continuation of application No. 17/180,871, filed on Feb. 22, 2021, now Pat. No. 11,294,314, which is a continuation of application No. 16/889,749, filed on Jun. 1, 2020, now Pat. No. 10,955,782, which is a continuation of application No. 16/254,985, filed on Jan. 23, 2019, now Pat. No. 10,698,350, which is a continuation of application No. 15/799,674, filed on Oct. 31, 2017, now Pat. No. 10,197,959, which is a continuation of application No. 14/861,125, filed on Sep. 22, 2015, now Pat. No. 9,804,545.

(30) Foreign Application Priority Data

Sep. 24, 2014 (JP) ..... 2014-193457

(51) Int. Cl.
*G03G 15/00* (2006.01)
*G03G 15/20* (2006.01)

(52) U.S. Cl.
CPC ..... *G03G 15/2053* (2013.01); *G03G 15/2042* (2013.01); *G03G 2215/2032* (2013.01)

(58) Field of Classification Search
USPC ..... 399/69, 122, 320, 328, 329
See application file for complete search history.

(56) References Cited

U.S. PATENT DOCUMENTS 4,883,941 A 11/1989 Martin et al.
6,026,273 A 2/2000 Kinouchi et al.
6,072,155 A * 6/2000 Tomatsu ..... G03G 15/2053 399/333

(Continued)

FOREIGN PATENT DOCUMENTS

CN 103676575 A 3/2014
EP 1847889 A2 10/2007

(Continued)

OTHER PUBLICATIONS

Japanese Office Action dated Dec. 14, 2017, filed in Japanese counterpart Application No. 2014-193457, 7 pages (with translation).

(Continued)

*Primary Examiner* — Hoan H Tran
(74) *Attorney, Agent, or Firm* — Kim & Stewart LLP

(57) ABSTRACT

A heat generating member includes a plurality of heat generating portions configured to generate heat and including a first heat generating portion having a meandering shape, and a plurality of second heat generating portions between two of which the first heat generating portion is disposed.

19 Claims, 6 Drawing Sheets

(56) References Cited

U.S. PATENT DOCUMENTS

| | | | | |
|---|---|---|---|---|
| 6,725,000 | B2 | 4/2004 | Takagi et al. | |
| 6,882,804 | B2 | 4/2005 | Eskey | |
| 6,900,419 | B2 | 5/2005 | Takagi et al. | |
| 7,139,495 | B2 | 11/2006 | Morihara et al. | |
| 7,187,880 | B2 | 3/2007 | Senda et al. | |
| 7,792,450 | B2 | 9/2010 | Takagi et al. | |
| 8,110,783 | B2 | 2/2012 | Sasaki et al. | |
| 8,112,023 | B2 | 2/2012 | Seo et al. | |
| 8,224,222 | B2 * | 7/2012 | Mitsuoka ..... | G03G 15/2064 399/329 |
| 8,592,726 | B2 | 11/2013 | Tsuruya et al. | |
| 8,653,422 | B2 | 2/2014 | Shimura et al. | |
| 8,731,424 | B2 | 5/2014 | Sano et al. | |
| 8,761,630 | B2 | 6/2014 | Hikari et al. | |
| 9,098,034 | B2 | 8/2015 | Shimura | |
| 9,235,166 | B2 | 1/2016 | Shimura | |
| 9,244,411 | B2 | 1/2016 | Seshita et al. | |
| 9,372,463 | B2 | 6/2016 | Shimura | |
| 9,804,545 | B2 | 10/2017 | Takagi | |
| 2014/0219696 | A1 | 8/2014 | Fujimoto et al. | |
| 2015/0338797 | A1 | 11/2015 | Matsumoto | |

FOREIGN PATENT DOCUMENTS

| | | | |
|---|---|---|---|
| EP | 2711778 | A2 | 3/2014 |
| JP | S63-041879 | A | 2/1988 |
| JP | 2629980 | B2 | 7/1997 |
| JP | H10270149 | A | 10/1998 |
| JP | 2000-206809 | A | 7/2000 |
| JP | 2004-341523 | A | 12/2004 |
| JP | 2007025474 | A | 2/2007 |
| JP | 2007240606 | A | 9/2007 |
| JP | 2007310353 | A | 11/2007 |
| JP | 2009-245729 | A | 10/2009 |
| JP | 2009-282335 | A | 12/2009 |
| JP | 2011-033939 | A | 2/2011 |
| JP | 2011128567 | A | 6/2011 |
| JP | 2012037613 | A | 2/2012 |
| JP | 2012252190 | A | 12/2012 |
| JP | 2014059508 | A | 4/2014 |
| WO | 2013/073276 | A1 | 5/2013 |

OTHER PUBLICATIONS

Chinese Office Action dated Aug. 10, 2017, filed in Chinese counterpali Application No. 201510552052.4, (16 pages with translation).

Extended European Search Report dated Feb. 3, 2016 mailed in counterpart European Application No. 15185086.4, 8 pages.

Notification of Reasons for Refusal dated Feb. 5, 2019 in corresponding Japanese Patent Application No. 2018-073210 with English machine translation, 9 pages.

Communication pursuant to Article 94(3) EPC dated Feb. 28, 2019 in corresponding European Patent Application No. 15185086.4, 4 pages.

Notice of Reasons for Refusal dated Aug. 4, 2020 in corresponding Japanese Patent Application No. 2019-181308, 7 pages (with Translation).

Notice of Reasons for Refusal dated Nov. 30, 2021 in corresponding Japanese Patent Application No. 2020-213721, 7 pages (with Translation).

* cited by examiner

FIXING DEVICE AND IMAGE FORMING APPARATUS

CROSS-REFERENCE TO RELATED APPLICATION

This application is a continuation of U.S. patent application Ser. No. 17/180,871, filed on Feb. 22, 2021, which application is a continuation of U.S. patent application Ser. No. 16/889,749, filed on Jun. 1, 2020, now U.S. Pat. No. 10,955,782, granted on Mar. 23, 2021, which application is a continuation of U.S. patent application Ser. No. 16/254,985, filed on Jan. 23, 2019, now U.S. Pat. No. 10,698,350, granted on Jun. 30, 2020, which application is a continuation of U.S. patent application Ser. No. 15/799,674, filed on Oct. 31, 2017, now U.S. Pat. No. 10,197,959, granted on Feb. 5, 2019, which application is a continuation of U.S. patent application Ser. No. 14/861,125, filed on Sep. 22, 2015, now U.S. Pat. No. 9,804,545, granted on Oct. 31, 2017, which application is based upon and claims the benefit of priority from Japanese Patent Application No. 2014-193457, filed on Sep. 24, 2014, the entire contents of each of which are incorporated herein by reference.

FIELD

Embodiments described herein relate generally to a fixing device and an image forming apparatus.

BACKGROUND

A fixing device mounted on an image forming apparatus typically employs a lamp that emits infrared rays, such as a halogen lamp, or an induction heating unit that generates heat by electromagnetic induction as a heat source for fixing an image to imaging medium.

In general, the fixing device includes a pair of a heating rollers (or a fixing belt stretched around a plurality of rollers) and a press roller. In such a fixing device, it is preferable that heat capacity of elements of the fixing device be reduced as much as possible and that only a region that contributes to fixing the image is heated, so that thermal efficiency of the fixing device is maximized.

DETAILED DESCRIPTION

Figure 1:
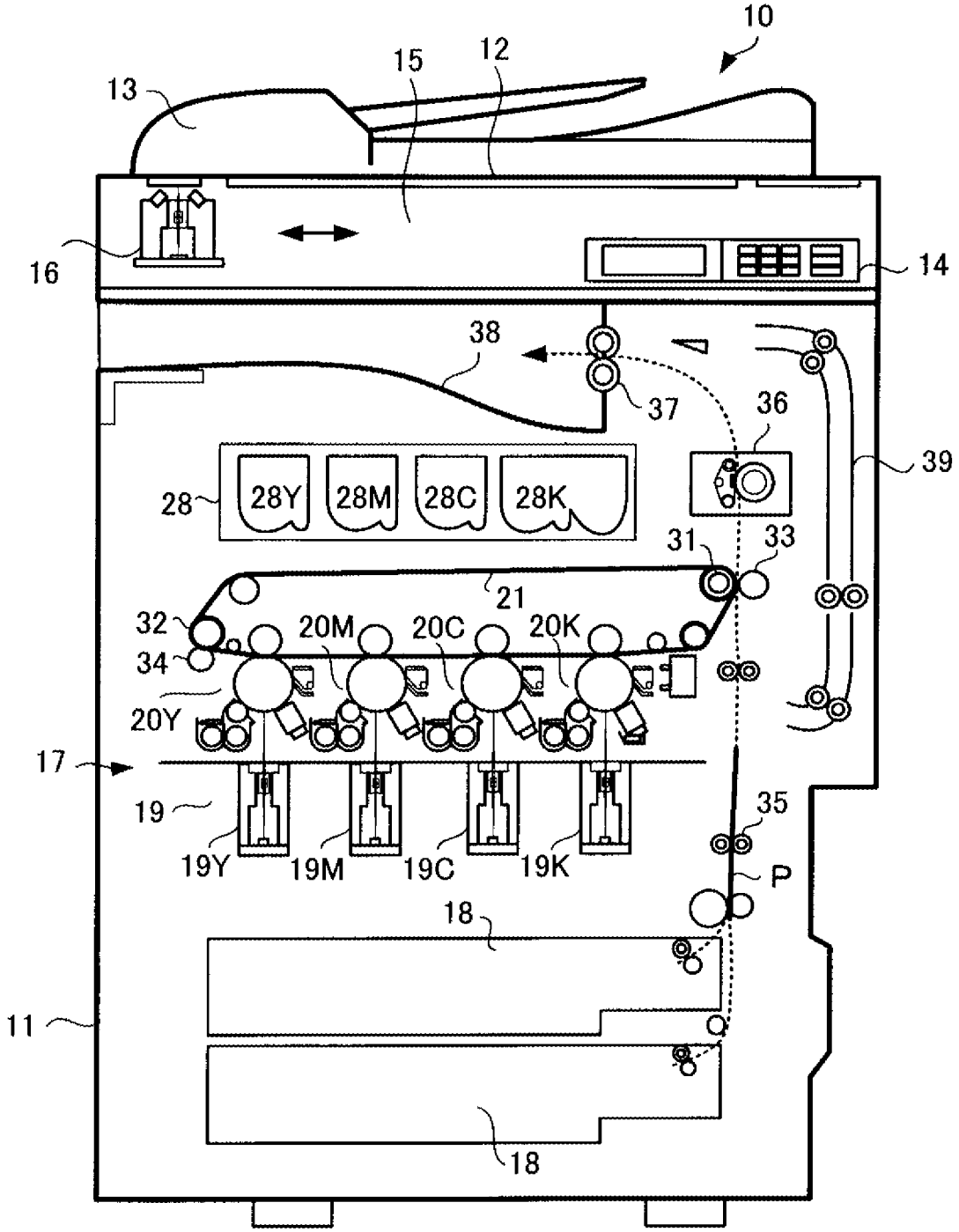
FIG. 1 illustrates a configuration of an image forming apparatus on which a fixing device according to an embodiment is mounted.

In an image forming apparatus using a thermal fixing processing, it is difficult to heat only a device region (i.e., a nip portion) used to fix an image because heat energy diffuses. Thus, it is difficult to optimize overall thermal efficiency. Furthermore, in the fixing device for electrophotography, when heating is uneven in a direction perpendicular to a sheet transport direction, it reduces fixing quality. Particularly, in a case of color printing, differences in color and glossiness may occur due to variations in heating across the image being fixed.

Furthermore, in the fixing device in which the heat capacity of the fixing elements is very low, temperature of the portions of the device through which a sheet does not pass will be significantly increased, which may result in a problem such as speed irregularity due to warpage of elements, deterioration of belts, expansion of a transport roller, and the like may occur. Furthermore, heating of device elements not directly used in the image fixing process is not preferable from the viewpoint of energy saving.

An embodiment is directed towards stably heating a sheet passing region and reducing energy consumption without compromising fixing quality.

In general, according to an embodiment, a fixing device includes a roller, an endless belt, and a heat generating member disposed in a space inside the endless belt, extending in a width direction of the endless belt, and pressing the endless belt against the roller. A sheet is passed in a sheet conveying direction through a nip formed between the roller and a portion of the endless belt pressed by the heat generating member, such that an image on the sheet is fixed thereto. The heat generating member includes first and second heat generating portions arranged or disposed along the width direction, and the first heat generating portion is independently operable from the second heat generating portion.

In another embodiment, a fixing device includes: a determination section that detects a size of a medium (e.g., a sheet of paper) on which a toner image has been or can be formed; a heating section that heats the medium and includes a rotating body having an endless shape (e.g., a belt), a plurality of heat generating members which have a same length in a transport direction of the medium, are divided into a plurality of different lengths in a direction perpendicular to the transport direction (e.g., width direction of the rotating body), of which temperature rising rates with respect to a same applied voltage are evenly adjusted, and which are provided in contact with an inside of the rotating body, and a switching unit that individually switches electric conduction with respect to the heat generating members; a pressing section (e.g., a roller) that forms a nip by coming into pressed contact with the heating section at positions corresponding to the plurality of heat generating members, and transports the medium in the transport direction by pinching the medium together with the heating section; and a heating control section that selects one or more heat generating members from among the plurality of heat generating members according to a detected size of the medium and otherwise controls heating in the heating section to provide even heating at positions in the nip corresponding to the width of the medium being passed through the nip.

Hereinafter, a fixing device according to an example embodiment will be described with reference to the drawings in detail. FIG. 1 illustrates a configuration an image forming apparatus on which the fixing device according to the present embodiment is mounted. In FIG. 1, for example, an image forming apparatus 10 is a Multi-Function Peripherals (MFP), a printer, a copying machine, and the like. In the following description, the MFP is described as an example.

A document table 12 of transparent glass is provided on an upper portion of a body 11 of the MFP 10, and an automatic document transport unit (ADF) 13 is provided on the document table 12, such that the ADF 13 is openable and closable. Furthermore, an operation unit 14 is provided on an upper portion of the body 11. The operation unit 14 has various keys and a touch panel type display device.

A scanner unit 15, which is a reading device, is provided in a lower portion of the ADF 13 within the body 11. The scanner unit 15 is provided to generate image data by reading a document sent by the ADF 13 or a document placed on the document table and includes a contact type image sensor 16 (hereinafter, simply referred to as image sensor). The image sensor 16 is arranged in a main scanning direction (depth direction in FIG. 1).

The image sensor 16 reads a document image line by line while moving along the document table 12 when reading the image of the document mounted on the document table 12. This process is performed on the entire region of the document to read the document of one page. Furthermore, the image sensor 16 is at a fixed position (position illustrated in FIG. 1) when reading the image of the document is sent by the ADF 13.

Furthermore, a printer unit 17 is provided in a center portion of the body 11 and a plurality of sheet feeding cassettes 18 for storing sheets P of various sizes is provided in the lower portion of the body 11.

The printer unit 17 processes image data read by the scanner unit 15 or image data created by a personal computer and the like to form a corresponding image on the sheet. For example, the printer unit 17 is a color laser printer of a tandem type and includes image forming units 20Y, 20M, 20C, and 20K of each color of yellow (Y), magenta (M), cyan (C), and black (K). The image forming units 20Y, 20M, 20C, and 20K are arranged in parallel below an intermediate transfer belt 21, in order, from an upstream side to a downstream side along a rotational direction of the intermediate transfer belt 21. Furthermore, a laser exposure device (scanning head) 19 also includes a plurality of laser exposure devices 19Y, 19M, 19C, and 19K corresponding to the image forming units 20Y, 20M, 20C, and 20K, respectively.

Figure 2:
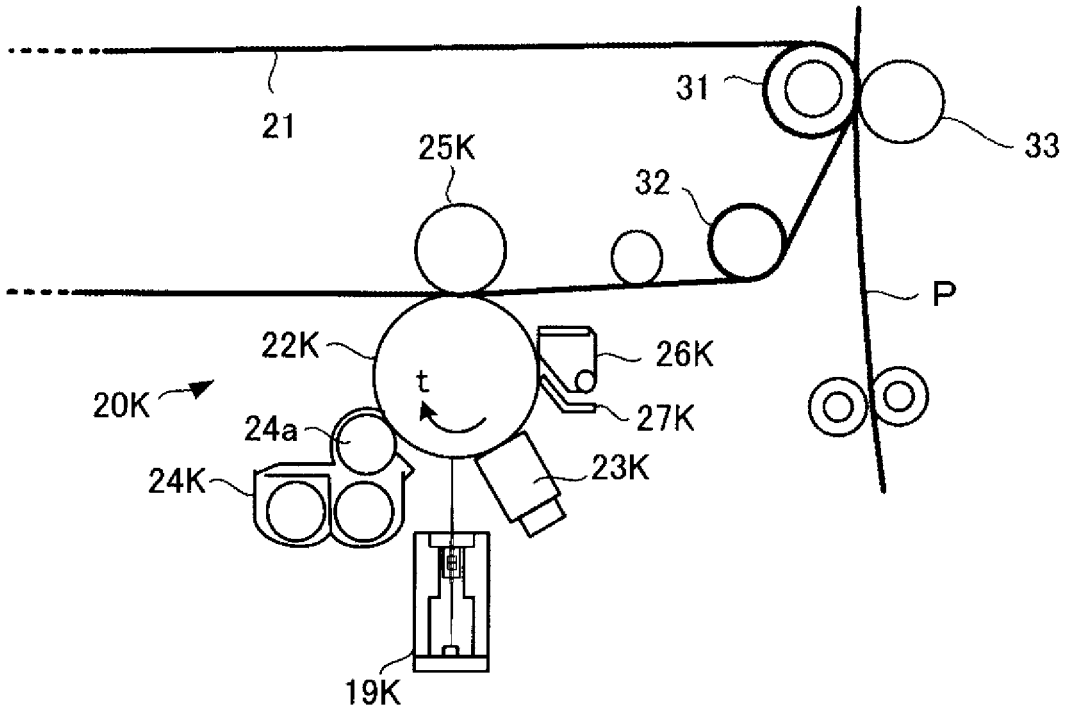
FIG. 2 illustrates an enlarged portion of an image forming unit of the image forming apparatus.

FIG. 2 illustrates the image forming unit 20K in an enlarged manner. In the following description, since the image forming units 20Y, 20M, 20C, and 20K respectively have the same configuration, the image forming unit 20K is described as an example.

The image forming unit 20K includes a photosensitive drum 22K, which is an image carrier. A charger (electric charger) 23K, a developer 24K, a primary transfer roller (transfer device) 25K, a cleaner 26K, a blade 27K, and the like are arranged around the photosensitive drum 22K, in a rotational direction t. Light from the laser exposure device 19K is applied to an exposure position of the photosensitive drum 22K, and an electrostatic latent image is formed on the photosensitive drum 22K.

The charger 23K of the image forming unit 20K uniformly charges a surface of the photosensitive drum 22K. The developer 24K supplies two-component developer containing black toner and carrier to the photosensitive drum 22K by a developing roller 24*a* to which developing bias is applied, and performs developing of the electrostatic latent image. The cleaner 26K removes residual toner on the surface of the photosensitive drum 22K using the blade 27K.

Furthermore, as illustrated in FIG. 1, a toner cartridge 28 for supplying toner to one of the developers 24Y to 24K is provided in an upper portion each of the image forming units 20Y to 20K. The toner cartridge 28 includes toner cartridges of one of colors of yellow (Y), magenta (M), cyan (C), and black (K).

The intermediate transfer belt 21 cyclically moves. The intermediate transfer belt 21 is stretched around a driving roller 31 and a driven roller 32. Furthermore, the intermediate transfer belt 21 faces and is in contact with photosensitive drums 22Y to 22K. A primary transfer voltage is applied to a position of the intermediate transfer belt 21 facing the photosensitive drum 22K by the primary transfer roller 25K, and the toner image on the photosensitive drum 22K is primarily transferred onto the intermediate transfer belt 21.

The driving roller 31 around which the intermediate transfer belt 21 is stretched is arranged to face a secondary transfer roller 33. When the sheet P passes between the driving roller 31 and the secondary transfer roller 33, a secondary transfer voltage is applied by the secondary transfer roller 33. Then, the toner image on the intermediate transfer belt 21 is secondarily transferred onto the sheet P. A belt cleaner 34 is provided in the vicinity of the driven roller 32 of the intermediate transfer belt 21.

Furthermore, as illustrated in FIG. 1, a sheet feeding roller 35 that transports the sheet P taken out from the sheet feeding cassette 18 is provided between the sheet feeding cassette 18 and the secondary transfer roller 33. Furthermore, a fixing device 36 is provided on a downstream of the secondary transfer roller 33 in a sheet conveying direction. Furthermore, a transport roller 37 is provided on a downstream of the fixing device 36 in the sheet conveying direction. The transport roller 37 discharges the sheet P to a sheet discharging unit 38. Furthermore, a reverse transport path 39 is provided on the downstream of the fixing device 36 in the sheet conveying direction. The reverse transport path 39 guides the sheet P towards the secondary transfer roller 33 by reversing the sheet P and is used when performing duplex printing. FIGS. 1 and 2 illustrate the configuration example of the MFP 10 and do not limit a structure of a portion of the image forming apparatus other than the fixing device 36. It is possible to use a known structure of an electrophotographic image forming apparatus.

Figure 3:
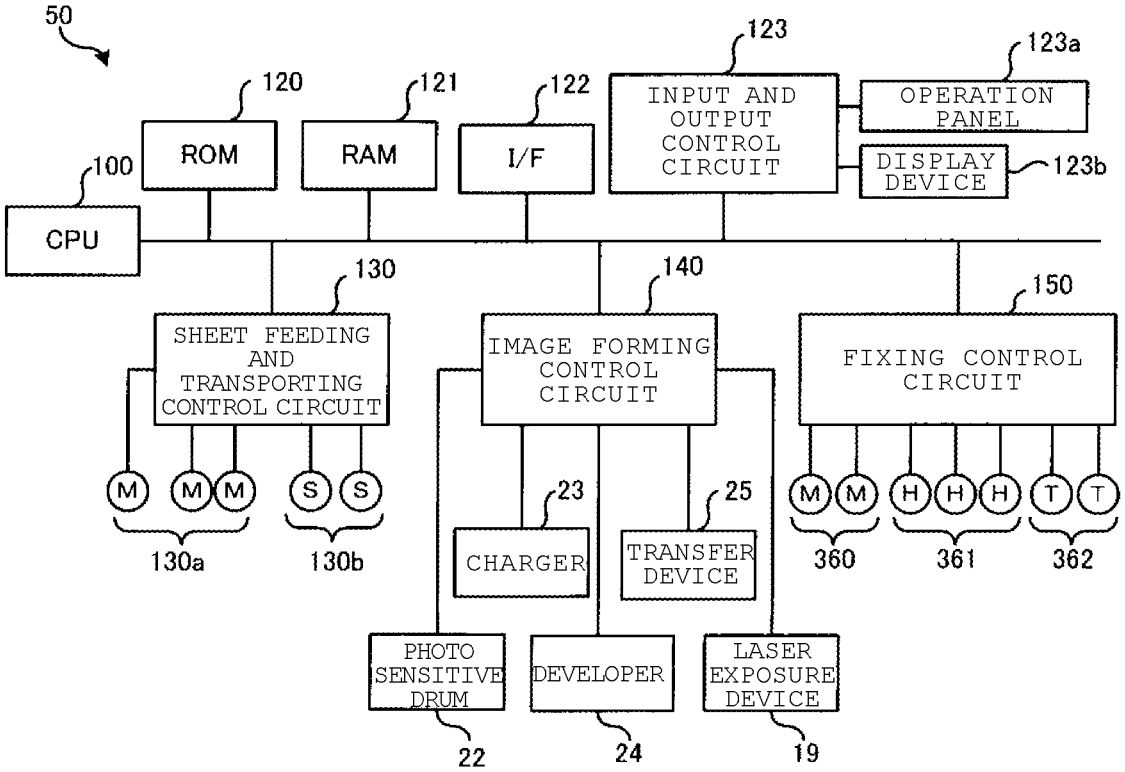
FIG. 3 is a block diagram of a control system of the image forming apparatus.

FIG. 3 is a block diagram of a control system 50 of the MFP 10 according to the present embodiment. For example, the control system 50 includes a CPU 100 for controlling an entirety of the MFP 10, a read only memory (ROM) 120, a random access memory (RAM) 121, an interface (I/F) 122, an input and output control circuit 123, a sheet feeding and transporting control circuit 130, an image forming control circuit 140, and a fixing control circuit 150.

The CPU 100 performs a processing function for forming the image by executing a program stored in the ROM 120 or the RAM 121. The ROM 120 stores a control program, control data, and the like to perform a basic operation of the image forming. The RAM 121 is a working memory. For example, the ROM 120 (or the RAM 121) stores control programs of the image forming unit 20, the fixing device 36, and the like, and various control data which are used to execute the control programs. In the present embodiment, the control data includes, for example, a correspondence relationship between a sheet passing region of the sheet, a size (width in the main scanning direction) of a printing region in the sheet, and a heat generating member that is electrically conducted.

A fixing temperature control program of the fixing device 36 includes a determination logic to determine the size of an image forming region in the sheet on which a toner image is formed and a heating control logic to select and electrically conduct a switching element of the heat generating member corresponding to the sheet passing region of the sheet before the sheet is transported to the fixing device 36 and control heating in the heating section.

The I/F 122 performs communication with various devices such as a user terminal and a facsimile. The input and output control circuit 123 controls an operation panel 123*a* and a display device 123*b* of the operation unit 14. The sheet feeding and transporting control circuit 130 controls a motor group 130*a* and the like that drives the sheet feeding roller 35, the transport roller 37 of the transport path, and the like. The sheet feeding and transporting control circuit 130 controls the motor group 130*a* and the like based on a detection result of various sensors 130*b* disposed in the vicinity of the sheet feeding cassette 18 or on the transport path, in accordance with a control signal from the CPU 100. The image forming control circuit 140 controls the photosensitive drum 22, the charger 23, the laser exposure device 19, the developer 24, and the transfer device 25 in accordance with a control signal from the CPU 100, respectively. The fixing control circuit 150 controls a driving motor 360, a heating member 361, a temperature detecting member 362 such as thermistor of the fixing device 36 in accordance with the control signal from the CPU 100, respectively. Furthermore, in the present embodiment, the control program and control data of the fixing device 36 are stored in a storage device of the MFP 10 and executed by the CPU 100, but a calculation processing device and a storage device dedicated for the fixing device 36 may be separately provided.

Figure 4:
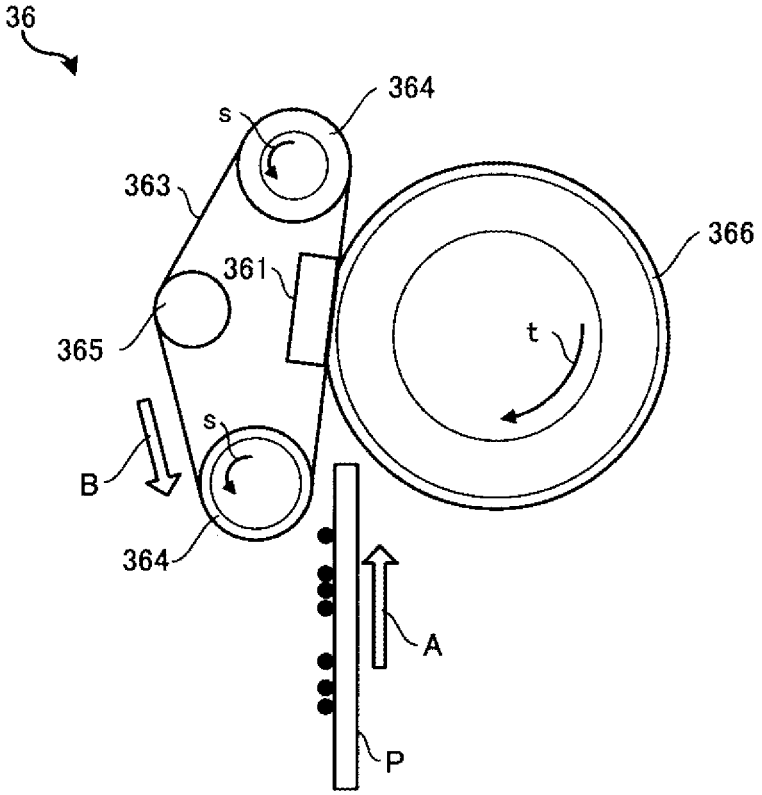
FIG. 4 illustrates a configuration of the fixing device according to the embodiment.

FIG. 4 illustrates a configuration example of the fixing device 36. Here, the fixing device 36 includes the plate-shaped heating member 361, an endless belt 363 on which an elastic layer is formed and which is wound around a plurality of rollers, a belt transporting roller 364 that drives the endless belt 363, a tension roller 365 to extend the endless belt 363, and a press roller 366 where an elastic layer is formed on a surface thereof. A side of the heating member 361 on which a heat generation unit is disposed is in contact with an inside of the endless belt 363, and the heating member 361 is urged towards the press roller 366, whereby a fixing nip having a predetermined width is formed between the heating member 361 and the press roller 366. Since the heating member 361 applies heat while forming a nip region, the sheet passing through the nip can be heated more quickly than a heating system using a halogen lamp.

For example, the endless belt 363 is obtained by forming a silicone rubber layer having a thickness of 200 μm on an outside of a layer formed of an SUS base material having a thickness of 50 μm or heating-resistant resin (e.g., polyimide) having a thickness of 70 μm, and by coating the outermost periphery with a surface protecting layer such as PFA. The press roller 366 includes, for example, a silicone sponge layer having a thickness of 5 mm formed on a surface of an iron rod having φ 10 mm, and the outermost periphery is coated with the surface protecting layer such as PFA.

Furthermore, the heating member 361 is obtained by stacking a glaze layer and a heating-resistant layer on a ceramic base layer. In order to prevent warpage of the ceramic base layer while conducting excessive heat on the other side, the heating-resistant layer is, for example, formed of a known material such as $TaSiO_2$ and is divided into parts of predetermined lengths and predetermined numbers in the main scanning direction (i.e., a width direction of the endless belt 363).

A method of forming the heating-resistant layer is similar to a known method (for example, a method of creating a thermal head), and an aluminum or masking layer is formed on the heating-resistant layer. The aluminum layer is formed in a pattern in which a portion between adjacent heat generating members is insulated, and a heat generation resistor (heat generating member) is exposed in a sheet conveying direction. Electric conduction to a heat generating member 361*a* is achieved by providing wiring from aluminum layers (electrodes) of both ends and connecting each wiring to the switching element of a switching driver IC. Furthermore, a protective layer is formed on the upper limit portion to cover an entirety of the heat generation resistor, the aluminum layer, the wiring, and the like. For example, the protective layer is formed of $Si_3N_4$ and the like.

Figure 5:
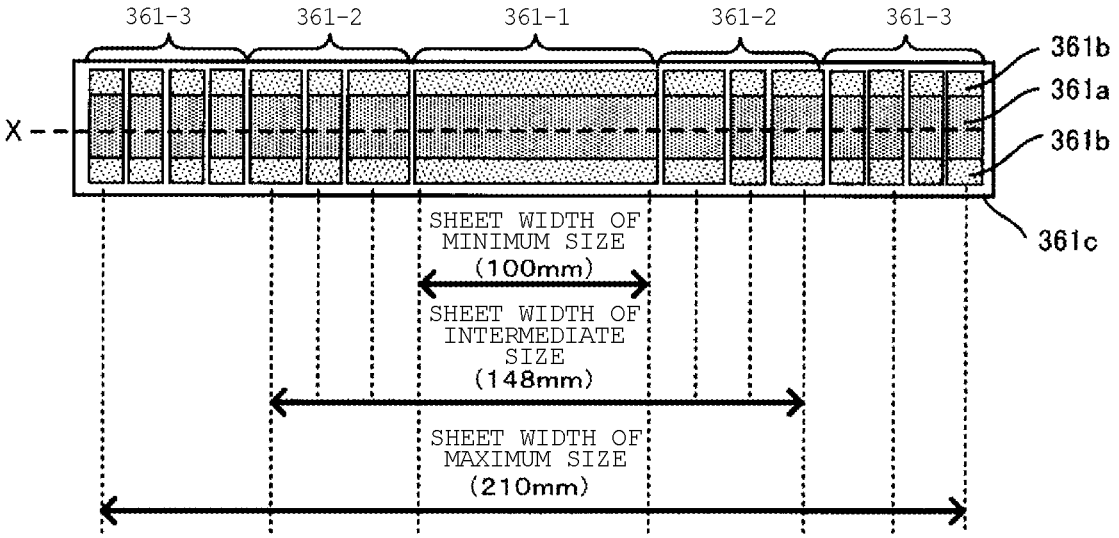
FIG. 5 illustrates a layout of a heat generating member group of the fixing device according to the embodiment.

FIG. 5 illustrates a layout of a heat generating member group according to the present embodiment. As illustrated in FIG. 5, the heat generating members 361*a* having various lengths in right and left directions in FIG. 5 are formed on a ceramic substrate 361*c* in parallel, and electrodes 361*b* are formed in both ends of the heat generating member 361*a* in the sheet conveying direction (up and down directions in FIG. 5). Furthermore, the length of the heat generating member 361*a* is uniform in the sheet conveying direction so that a heating time (passing time of the sheet) by each heat generating member 361*a* is constant.

As illustrated in FIG. 5, in the present embodiment, the heating member 361 includes the heat generating members 361*a* having the plurality of types of lengths in right and left directions. Specifically, the heating member 361 is divided into the heat generating members (heat generation elements) 361*a* having the plurality of types of lengths corresponding to a postcard size (100×148 mm), a CD jacket size (121×121 mm), a B5R size (182×257 mm), and an A4R size (210×297 mm). The heat generating member group is arranged, such that the heated region is approximately 5% or approximately 10 mm larger than the size of the sheet, taking into account transport accuracy, skew of the transported sheet, and escape of heat to a non-heating portion.

For example, in order to correspond to a width of 100 mm of a postcard size, which is the minimum size, a first heat generating member group 361-1 is provided at a center portion in the main scanning direction (right and left directions in FIG. 5) and a width thereof is 105 mm. Next, in order to correspond to large sizes of 121 mm and 148 mm, a second heat generating member group 361-2 having a width of 50 mm is arranged on an outside (right and left directions in FIG. 5) of the first heat generating member group 361-1 and covers a width of up to 155 mm (obtained by 148 mm with plus 5%). Furthermore, in order to correspond to large sizes of 182 mm and 210 mm, a third heat generating member group 361-3 having a width of each heat generating member being 65 mm is provided on a further outside of the second heat generating member group 361-2 and covers a width of up to 220 mm that is obtained by 210 mm with plus 5%. In addition, the number of divisions of the heat generating member groups and each width thereof are an example and the disclosure is not limited to the example. For example, when the MFP 10 corresponds to five medium sizes, the heat generating member group may be divided into five according to the size of each medium.

Furthermore, in the present embodiment, a line sensor (not illustrated) is arranged in the sheet passing region, and it is possible to determine the size and the position of the passing sheet in real time. Alternatively, the sheet size may be determined based on the image data when starting the print operation or information of the sheet feeding cassette 18 in which the sheets are stored.

Furthermore, as illustrated in FIG. 5, when electric conduction is performed with respect to the entirety of the plurality of heat generating members 361*a* with the same conditions, since the lengths are different in right and left directions in FIG. 5, the heat generation amount (power consumption) of each heat generating member 361*a* may be different, and it is unlikely to heat uniformly.

In the present embodiment, the heat generation amount is adjusted to be uniform by optimally adjusting at least one of (1) each thickness of the heat generating member 361*a*, (2) a length between power feeding units (electrodes 361*b*) of the heat generation pattern, and (3) the resistivity of the heat generating member 361*a*. Adjustments by (1) to (3) may be appropriately combined. For example, the lengths of the heat generating members 361*a* in the sheet conveying direction are adjusted to be the same as each other and an output W of the heat generating member 361*a* is proportioned to a length that is divided in a direction perpendicular to the sheet conveying direction.

The output W of the divided heat generating member 361*a* is (supply voltage V)$^2$=W×(electric resistance R of the heat generating member 361*a*). Furthermore, a relationship between the supply voltage V and a current I is V=I×R. Thus, the electric resistance R of each heat generating member 361*a* is adjusted to satisfy a relationship of $W=V^2/R=I^2/R$. Even when the resistivity of the heat generating members 361*a* are the same as each other, it is possible to adjust the electric resistance R by changing the length (conduction distance between electrodes) or the thickness.

For example, in order to increase the electric resistance R, a cross sectional area is reduced or the flow path of the current is extended. In the case that the applied voltage is constant, when increasing the electric resistance R, the current I becomes smaller. Conversely, when the electric resistance R is doubled, the current I becomes ½. In this case, the heat generation amount of the heater becomes $(½)^2$×2 and, as a result, becomes ¼. Furthermore, when the thicknesses of the heat generating members 361*a* are the same as each other, it is possible to prevent heat radiation by varying the size in a longitudinal direction. Specifically, it is possible to promote heat generation by increasing the size in the longitudinal direction. When the thicknesses of the heat generating members 361*a* are the same as each other, the heat generation amount per unit area is the same. When escaping heat (heat radiation) of each heater in the right and left directions is the same, a large area is advantageous in terms of a temperature rise. In FIG. 5, when the thicknesses are the same, the temperature rise of the heat generating member 361*a* at the center is the fastest. On the other hand, a change in the resistivity can also be performed by selection of a material of the heat generating member 361*a*—that is, different materials may be used for providing the different heat generating members and the different materials may have different resistivity.

Figure 6:
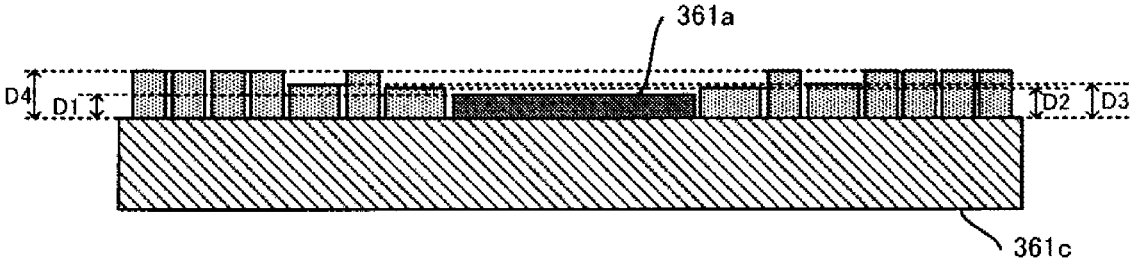
FIG. 6 is a cross-sectional view of the heat generating member group, which is taken along broken line X illustrated in FIG. 5.

FIG. 6 is a cross-sectional view of the heat generating member group, which is taken along broken line X in FIG. 5. Here, the heat generation of each heat generating member 361*a* is adjusted to be uniform by changing thickness of each of the heat generating members 361*a*. Since the length of the heat generating member 361*a* arranged at the center is relatively long in the right and left directions in FIG. 5, as described above, the heat generating member 361*a* is likely to generate the largest amount of heat when the thickness and the voltage V are the same for each heat generating member. Thus, a thickness D1 of the heat generating member 361*a* at the center is formed so as to be thinner than thicknesses D2 to D4 of other adjacent heat generating members 361*a*. A value of the output W of the heat generating member 361*a* is thus adjusted by reducing the cross sectional area and increasing the electric resistance R.

Figure 7:
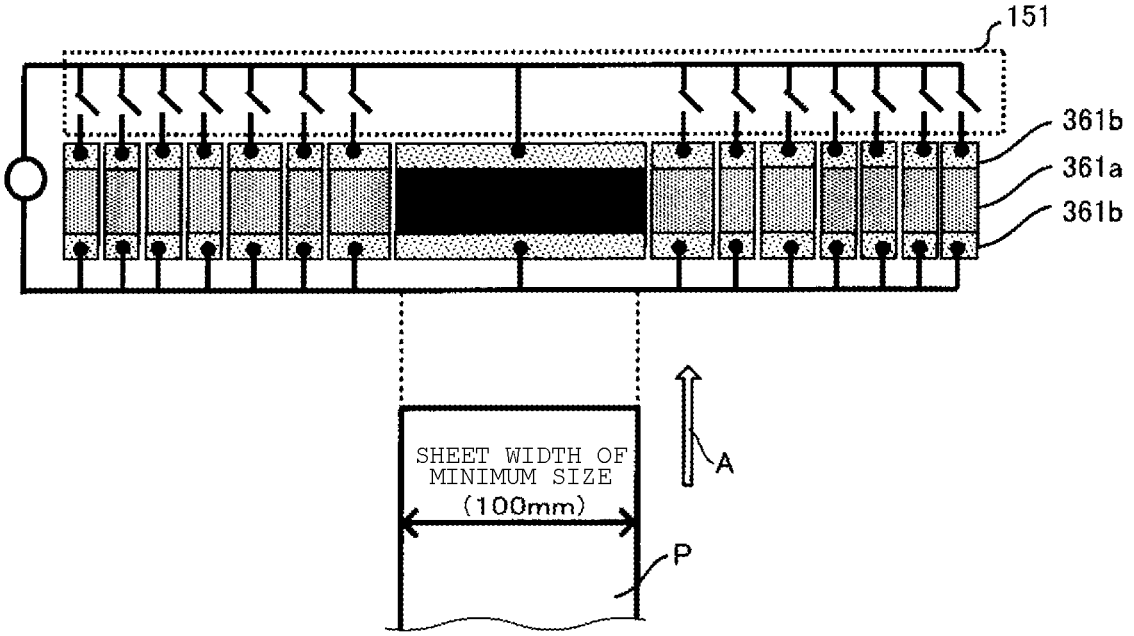
FIG. 7 illustrates a connection state between the heat generating member group and a driving circuit of the fixing device according to the embodiment.

FIG. 7 illustrates a connection state between the heat generating member group and a driving circuit thereof. As illustrated in FIG. 7, electric conduction of each heat generating member 361*a* is individually controlled by a driving IC 151. Each heat generating member 361*a* is connected in parallel so that the same potential is applied to each heat generating member 361*a*. The driving IC 151 is a switching unit of electric conduction with respect to each heat generating member 361*a*, and is formed of, for example, a switching element, an FET, a triac, a switching IC, and the like. In FIG. 7, the voltage is applied to each heat generating member 361*a* with an alternating current to generate heat, but a direct current may be used. In the present embodiment, when the sheet P is transported in the sheet conveying direction indicated by an arrow A (FIG. 7), only the heat generating member 361*a* corresponding to the sheet passing region (which corresponds to the width and positioning of the sheet P) of the sheet P is selectively electrically conducted and heat is intensively applied to only the sheet passing region of the sheet P.

For example, when the sheet P is the minimum size (e.g., postcard size), only the switching element of the first heat generating member group 361-1 arranged at the center (FIG. 5) is turned ON to generate heat. When the size of the sheet P is large, the switching elements of the second heat generating member group 361-2 (FIG. 5) and the third heat generating member group 361-3 (FIG. 5) are controlled to be sequentially turned ON. Electric resistance is adjusted such that the first to third heat generating member groups 361-1, 361-2, 361-3 have uniform temperature rising rate.

Figure 8:
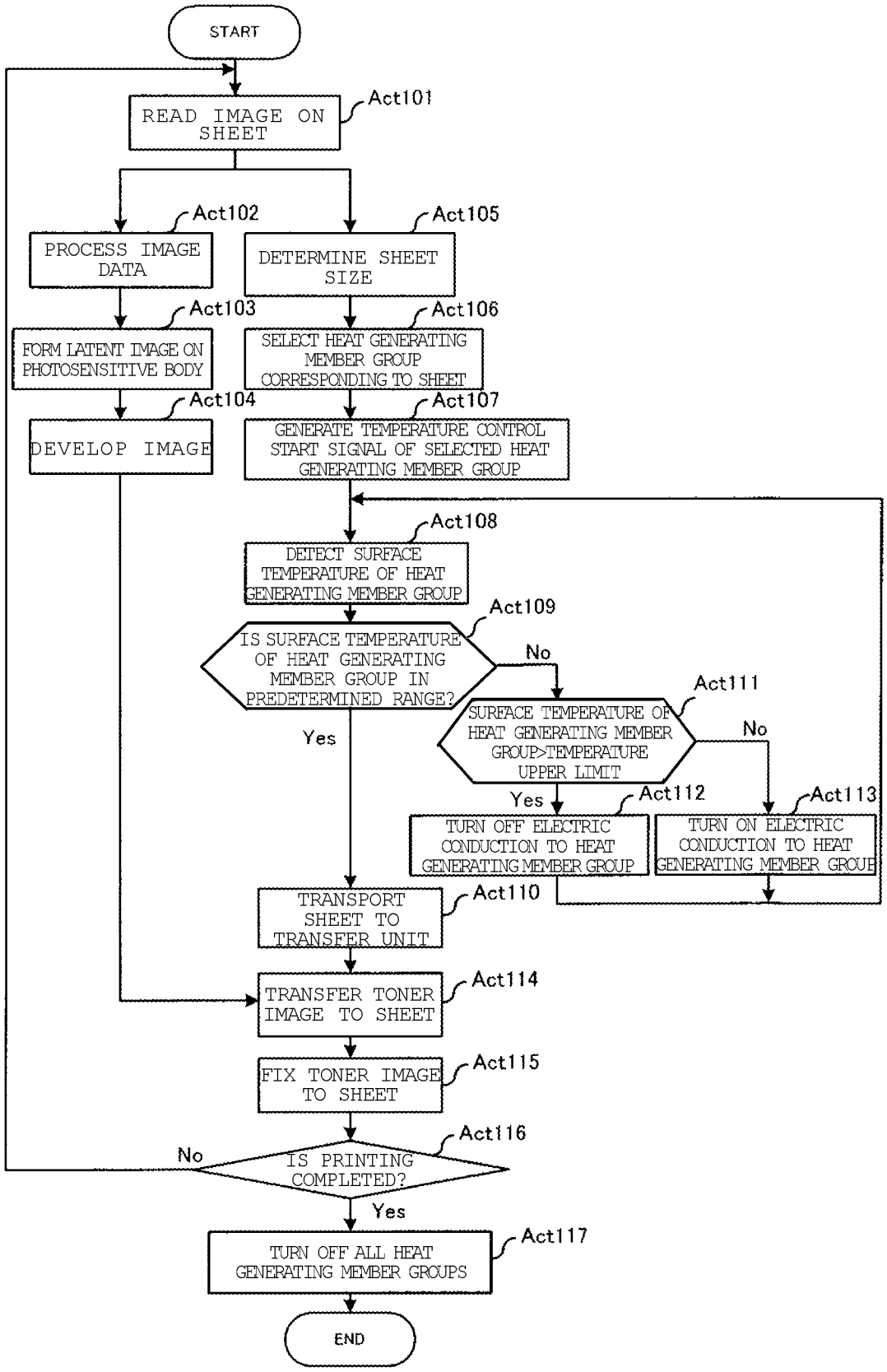
FIG. 8 is a flowchart of a control operation carried out by the image forming apparatus.

Hereinafter, a printing operation performed by the MFP 10 configured as described above will be described with reference to FIG. 8. FIG. 8 is a flowchart of the printing operation performed by the MFP 10 according to the present embodiment.

First, when the image data is read by the scanner unit 15 (Act101), an image forming control program to control the image forming unit 20 and a fixing temperature control program to control the fixing device 36 are executed in parallel.

When the image forming is started, the read image data is processed (Act102), the electrostatic latent image is formed on the surface of the photosensitive drum 22 (Act103), the electrostatic latent image is developed by the developer 24 (Act104), and then the process proceeds to Act114.

When the fixing temperature controlling is started, for example, the sheet size is determined based on a detection signal of a line sensor (not illustrated) and sheet selection information by the operation unit 14 (Act105). Then, the heat generating member group arranged in the position (sheet passing region) through which the sheet P passes is selected as a heat generation object (Act106).

Next, when a temperature control start signal to the selected heat generating member group is generated (Act107), the electric conduction is performed to the selected heat generating member group, and a surface temperature of the heat generating member group increases. That is, when the heating region is determined, all selected heat generating members 361*a* are actuated by the same control. In this case, the heat generating members 361*a* which are electrically conducted generate heat at a uniform temperature rising rate.

Next, when the surface temperature of the heat generating member group is detected by a temperature detecting member (not illustrated) arranged on the inside or the outside of the endless belt 363 (Act108), it is determined whether or not the surface temperature of the heat generating member group is in a predetermined temperature range (Act109). Here, when it is determined that the surface temperature of the heat generating member group is in the predetermined temperature range (Act109: Yes), the process proceeds to Act110. On the other hand, when it is determined that the surface temperature of the heat generating member group is not in the predetermined temperature range (Act109: No), the process proceeds to Act111.

In Act111, it is determined whether or not the surface temperature of the heat generating member group exceeds a predetermined upper limit value. Here, when it is determined that the surface temperature of the heat generating member group exceeds the predetermined upper limit value (Act111: Yes), the electric conduction to the heat generating member group selected in Act106 is turned OFF (Act112) and the process returns to Act108. On the other hand, when it is determined that the surface temperature of the heat generating member group does not exceed the predetermined upper limit value (Act111: No), since the surface temperature is less than the predetermined lower limit value according to a determination result of Act109, the electric conduction to the heat generating member group is maintained to be in an ON state or turned ON again (Act113), and the process returns to Act108.

Next, in a state where the surface temperature of the heat generating member group is in the predetermined temperature range, the sheet P is transported to a transfer unit (Act110), and then the toner image is transferred to the sheet P (Act114). Thereafter, the sheet P is transported towards the fixing device 36.

Next, when the toner image is fixed in the sheet P within the fixing device 36 (Act115), it is determined whether or not the printing of the image data is completed (Act116). Here, when it is determined that the printing is completed (Act116: Yes), the electric conduction to all the heat generating member groups is turned OFF (Act117) and the process is completed. On the other hand, when it is determined that the printing of the image data is not completed (Act116: No), that is, when the image data of the printing object remains, the process returns to Act101 and the same process is repeated until the process is completed.

As described above, according to the present embodiment, it is possible to not only prevent abnormal heat generation of a non-sheet passing portion of the heat generating member, but also suppress wasteful heating of the non-sheet passing portion of the heat generating member by switching the heat generating member group object based on a group to which the sheet size to be used belongs. Thus, it is possible to significantly reduce thermal energy consumed by the fixing device 36. Furthermore, since electric resistance is adjusted in advance such that the divided heat generating member 361*a* has the uniform temperature rising rate, even when the heat generating members 361*a* have various lengths, it is possible to uniformly heat regardless of the position through which the sheet passes.

Modification Example

Figure 9:
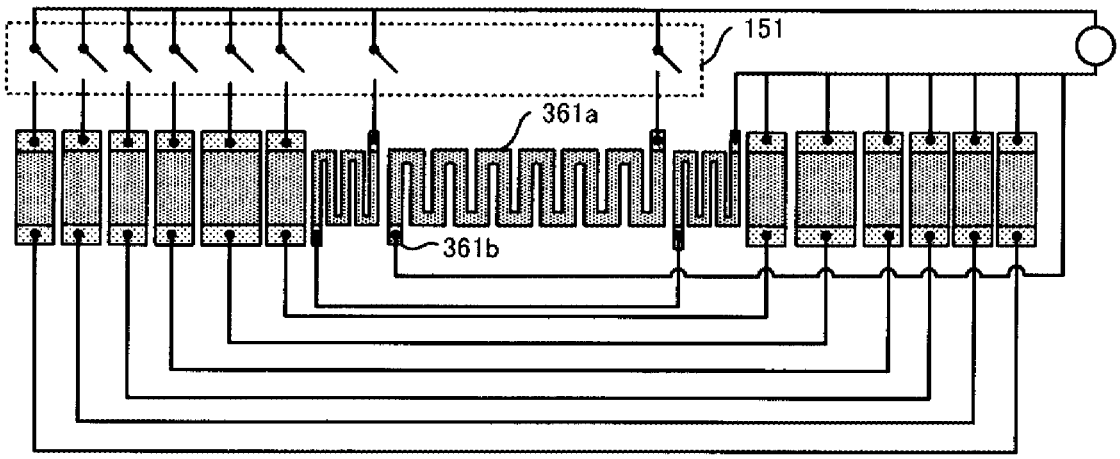
FIG. 9 illustrates a connection state between a heat generating member group and a driving circuit thereof according to a modification example of the embodiment.

Hereinafter, some modification examples of the embodiment described above will be described with reference to FIGS. 9, 10A, and 10B in detail. FIG. 9 illustrates a connection state between a heat generating member group and a driving circuit thereof in a modification example of the above embodiment. Here, similar to a case of FIG. 5, heat generating members 361*a* of the same type are substantially symmetrically arranged in right and left with respect to the heat generating member 361*a* at the center. However, unlike the embodiment described above, when the same voltage is applied to the electrodes 361*b* of both ends, a distance between the electrodes 361*b* is adjusted by making the shape of the heat generating members 361*a* respectively arranged at the center and adjacent thereof in a meandering shape in up and down directions in FIG. 9, such that each heat generating member 361*a* has the same temperature rising rate in a state of no load (no contact with sheet or a pressing member). That is, even when the heat generating members 361*a* are formed of a material having the same resistivity and the same thickness, a flow path (between power feeding units of the heat generating member) of the current is increased and the electric resistance value is increased by forming the shape of the heat generating member 361*a* having large heat generation surface that is long and narrow in a meandering shape, and thus, a heat generation amount can be equalized for the center and side regions.

Furthermore, a pair of the heat generating members 361*a* that are arranged in symmetrical positions with respect to the center portion are connected in series, and driving thereof is controlled by the same switching element 151. Thus, it is possible to reduce the number of the switching elements and to suppress the device size and manufacturing cost.

Figure 10A:
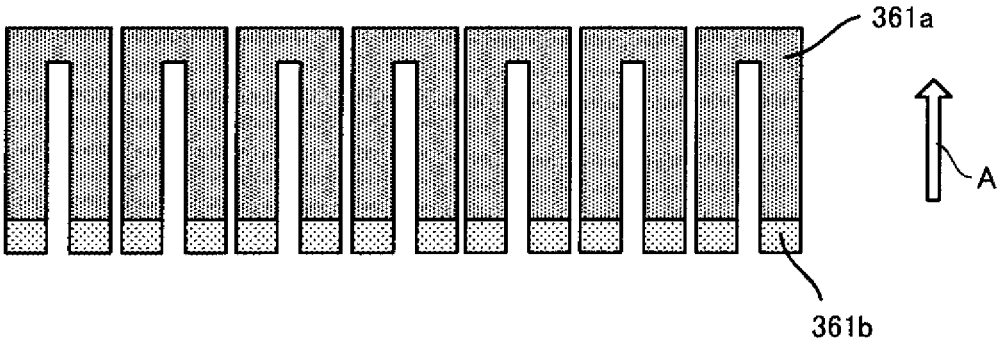
FIGS. 10A and 10B illustrate a shape of a heat generating member group according to other modification examples of the embodiment.
Figure 10B:
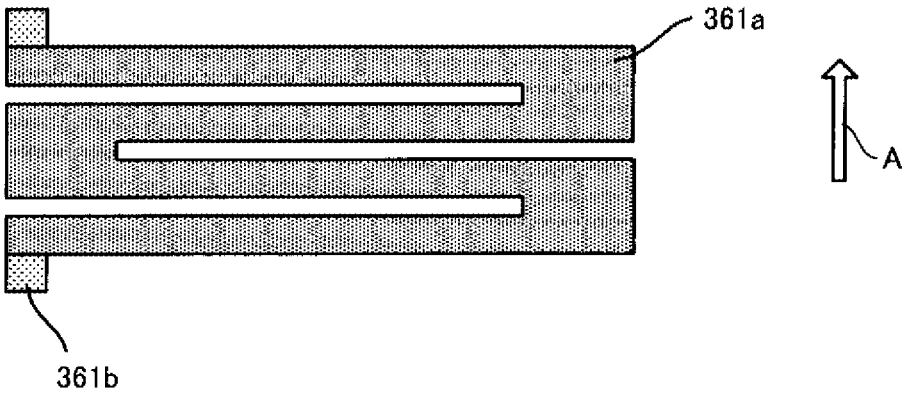

FIGS. 10A and 10B illustrate a shape of a heat generating member group in other modification examples of the above embodiment. In FIG. 10A, the heat generating members 361*a* formed in a U shape and having the same size are arranged side by side in the same orientation in a direction (right and left directions in FIG. 10A) perpendicular to a sheet conveying direction A. Thus, all the electrodes 361*b* are arranged on the lower side in FIG. 10A. In this case, all wirings may be concentrated on one side. Furthermore, in FIGS. 10A and 10B, all the heat generating members 361*a* have the same length, but similar to the embodiment described above, various lengths may be combined to take into account the temperature rising rate differences. In FIG. 10B, the heat generating members 361*a* are formed in the meandering shape in the direction (right and left directions in FIG. 10B) perpendicular to the sheet conveying direction A. The meandering direction of the heat generating members 361*a* is different from that of in FIG. 9 by 90 degrees, but it is possible to appropriately select the meandering direction depending on a wiring structure of the device.

Furthermore, in the embodiment described above, the size of the sheet passing region of the sheet P is determined based on sheet setting information before the sheet P reaches the fixing device 36. Alternatively, it is also possible to determine and heat the position through which a printing region (image forming region) is going to pass instead of the sheet passing region of the sheet. That is, less than a full sheet width may have the image to be formed thereon, thus only a portion of the sheet width may be required to be heated to fix the image formed thereon. A method of determining the size of the printing region of the sheet P includes a method of using an analysis result of image data, a method based on print format information such as margin setting of the sheet P, a method of determining based on a detection result of an optical sensor, and the like. In this case, since only a portion necessary to be fixed may be limitedly heated, it is possible to further increase energy saving efficiency.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A heat generating member comprising:

a plurality of heat generating portions configured to generate heat and including:

a first heat generating portion having a meandering shape, and a plurality of second heat generating portions between two of which the first heat generating portion is disposed, wherein the plurality of heat generating portions are arranged along a first direction, and a length of the first heat generating portion in the first direction is longer than a length of each of the second heat generating portions in the first direction.

2. The heat generating member according to claim 1, wherein each of the first and second heat generating portions has a same temperature rising rate when a same voltage is applied.

3. The heat generating member according to claim 1, wherein there is no other second heat generating portion between the two second heat generating portions.

4. The heat generating member according to claim 1, wherein the entire first heat generating portion is between the two second heat generating portions.

5. The heat generating member according to claim 1, wherein the meandering shape is formed in a shape meandering in a second direction perpendicular to the first direction.

6. The heat generating member according to claim 5, wherein each of the first and second heat generating portions is connected to electrodes at both ends thereof in the second direction.

7. The heat generating member according to claim 6, wherein the electrodes are not in line along the second direction.

8. The heat generating member according to claim 1, wherein the meandering shape is formed in a shape meandering in the first direction.

9. The heat generating member according to claim 8, wherein each of the first and second heat generating portions is connected to electrodes at both ends thereof in a second direction perpendicular to the first direction.

10. The heat generating member according to claim 9 wherein the electrodes are in line along the second direction.

11. The heat generating member according to claim 1, wherein a length of a path of current flow in the first heat generating portion is greater than a length of a path of current flow in each of the second heat generating portions.

12. The heat generating member according to claim 1, wherein the plurality of second heat generating portions is electrically connected in series, and the plurality of second heat generating portions is electrically connected in parallel with the first heat generating portion.

13. The heat generating member according to claim 1, further comprising:

a base layer on which the first and second heat generating portions are arranged.

14. The heat generating member according to claim 13, wherein a length of the first heat generating portion in a longitudinal direction of the base layer is greater than a length of each of the second heat generating portions in the longitudinal direction.

15. The heat generating member according to claim 13, wherein a length of the first heat generating portion in a direction perpendicular to a longitudinal direction of the base layer is less than a length of each of the second heat generating portions in the direction perpendicular to the longitudinal direction.

16. The heat generating member according to claim 1, wherein a resistivity of the first heat generating portion is greater than a resistivity of each of the second heat generating portions.

17. The heat generating member according to claim 1, wherein each of the second heat generating portions has a meandering shape.

18. A fixing device comprising:

a roller;

an endless belt having a portion facing the roller; and a heat generating member disposed such that the portion of the endless belt is between the heat generating member and the roller, the heat generating member including:

a plurality of heat generating portions configured to generate heat and including:

a first heat generating portion having a meandering shape, and a plurality of second heat generating portions between two of which the first heat generating portion is disposed.

19. An image forming apparatus comprising:

an image forming unit configured to form an image on a sheet;

a roller configured to convey the sheet;

an endless belt having a portion facing the roller; and a heat generating member disposed such that the portion of the endless belt is between the heat generating member and the roller, the heat generating member including:

a plurality of heat generating portions configured to generate heat and including:

a first heat generating portion having a meandering shape, and a plurality of second heat generating portions between two of which the first heat generating portion is disposed.

* * * * *